US007997191B2

(12) United States Patent
Chrysson

(10) Patent No.: US 7,997,191 B2
(45) Date of Patent: Aug. 16, 2011

(54) HAND-HELD TRASH COMPACTOR

(76) Inventor: Paul Chrysson, Winston Salem, NC (US)

( * ) Notice: Subject to any disclaimer, the term of this patent is extended or adjusted under 35 U.S.C. 154(b) by 0 days.

(21) Appl. No.: 11/895,856

(22) Filed: Aug. 28, 2007

(65) Prior Publication Data

US 2009/0056565 A1 Mar. 5, 2009

(51) Int. Cl.
*B30B 15/06* (2006.01)

(52) U.S. Cl. ..... 100/295; 100/265

(58) Field of Classification Search ..... 100/226, 100/265, 295, 299; 68/122, 215–219; 241/168, 241/169.2; 404/133.1; 81/19, 20; D7/682; D8/14; D15/123; D32/35; 220/507, 771, 220/23.83, 23.86

See application file for complete search history.

(56) References Cited

U.S. PATENT DOCUMENTS 947,548 A * 1/1910 Lind ..... 404/133.1
1,007,536 A * 10/1911 Cooley ..... 404/133.1
1,096,445 A * 5/1914 McKesson ..... 404/133.1
1,706,575 A * 3/1929 Jackson ..... 104/10
2,910,714 A * 11/1959 Becker ..... 15/244.1
2,994,262 A * 8/1961 Bator ..... 100/65
3,299,802 A * 1/1967 Black, Jr. ..... 100/233
3,565,351 A * 2/1971 Ross et al. ..... 241/99
3,782,845 A * 1/1974 Briggs et al. ..... 404/133.1
4,058,210 A * 11/1977 Mitchell ..... 206/372
4,188,877 A * 2/1980 Khan ..... 100/290
4,416,197 A 11/1983 Kehl ..... 100/214
4,649,813 A 3/1987 Kehl ..... 100/227
D347,942 S * 6/1994 Gilbert et al. ..... D3/308
5,439,108 A * 8/1995 Lackie ..... 206/373
5,680,932 A * 10/1997 Dickinson et al. ..... 206/372
5,781,956 A * 7/1998 Kelsay et al. ..... 15/143.1
5,797,314 A 8/1998 Hendrick ..... 100/265
5,857,408 A * 1/1999 Witter ..... 100/265
5,870,951 A * 2/1999 Fragstein ..... 100/245
6,591,744 B2 * 7/2003 Peek ..... 100/171
6,604,256 B1 * 8/2003 Pytlewski ..... 15/235.4
7,017,740 B2 * 3/2006 Itzkovitch ..... 206/372
2003/0235470 A1 * 12/2003 Gelb et al. ..... 404/133.1

* cited by examiner

*Primary Examiner* — Jimmy T Nguyen

(74) *Attorney, Agent, or Firm* — Ohlandt, Greeley, Ruggiero & Perle, L.L.P.

(57) ABSTRACT

A hand-held trash compactor that is lightweight, portable, easy to store, and usable with a wide variety of trash receptacles. The hand held trash compactor includes a base with a top surface. A handle extends upward from the top surface and is removably connected to the base. A hook can be pivotally connected to the base.

9 Claims, 4 Drawing Sheets

HAND-HELD TRASH COMPACTOR

BACKGROUND OF THE INVENTION

1. Field of the Invention

The present disclosure relates to trash compactors. More specifically, the present disclosure relates to hand-held trash compactors that are lightweight and portable.

2. Description of the Related Art

Handling and disposing of trash generated in a home, yard, or office can be a messy and tedious chore. It is often necessary or desirable to compact the trash in a trash receptacle, allowing more trash to be placed in the receptacle before the trash needs to be emptied. Many people resort to using their hands or feet to compact the trash. This practice, in addition to being unpleasant and unsanitary, exposes the person to possible injury from glass, cans, and other sharp objects that are often found in trash receptacles.

Trash compactors are known in the art. Previous trash compactors include complex mechanical, hydraulic, or electrical systems. Trash compactors including such systems are expensive, difficult to transport from one location to another, and may not be practical for outdoor use. Manual trash compactors are also known in the art. However, prior-art manual trash compactors are typically integrated with a specific trash receptacle, or are only suitable for use with a specific type of trash receptacle. In addition, the prior art compactors are bulky and difficult to store.

BRIEF SUMMARY OF THE INVENTION

A hand-held trash compactor that is lightweight, portable, easy to store, and usable with a wide variety of trash receptacles. The hand held trash compactor includes a base with a top surface. A handle extends upward from the top surface and is removably connected to the base. Preferably, a hook is pivotally connected to the base.

DETAILED DESCRIPTION OF THE INVENTION

Figure 1:
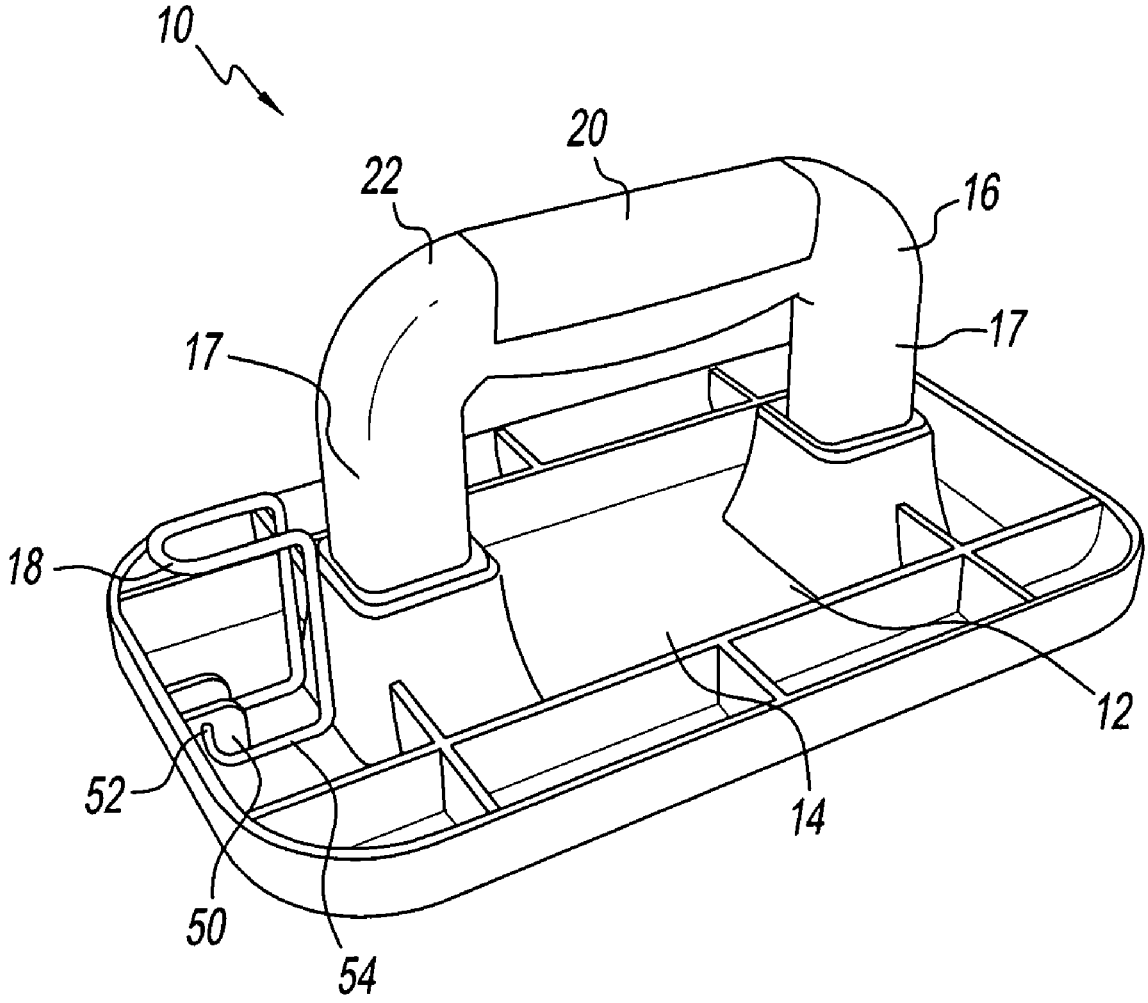
FIG. 1 is a top perspective view of a hand-held trash compactor.

Referring to the drawings and in particular FIG. 1, there is shown a hand-held trash compactor generally represented by reference numeral 10. Trash compactor 10 has a base 12 with a top surface 14. A handle 16 extends upward from top surface 14 of base 12. Base 12 preferably has a hook 18 pivotally connected to the base. By gripping handle 16 of trash compactor 10 and exerting a downward force, a user can effectively compact a quantity of trash within a trash receptacle without touching the trash.

In the preferred embodiment shown in FIG. 1, handle 16 is substantially U-shaped. As used in this disclosure, U-shaped means having two substantially parallel arms 17 joined by a connecting member. Advantageously, U-shaped handle 16 allows the user of trash compactor 10 to more evenly apply the downward force to the trash being compacted when compared with a dowel or broomstick type handle. Handle 16 is ergonomically shaped to allow a user to comfortably grip the handle while using trash compactor 10. Preferably, handle 16 includes a cushioning material 20 where a user's hand contacts the handle. In the embodiment shown in FIG. 1, handle 16 includes cushioning material 20 on an upper portion 22 of the handle. Alternatively, cushioning material 20 could be incorporated into other portions of handle 16. Cushioning material 20 may comprise polyurethane foam, polymeric foam, foamed polymeric laminate, polyvinyl, foam encased plastic, and foamed neoprene.

Figure 2:
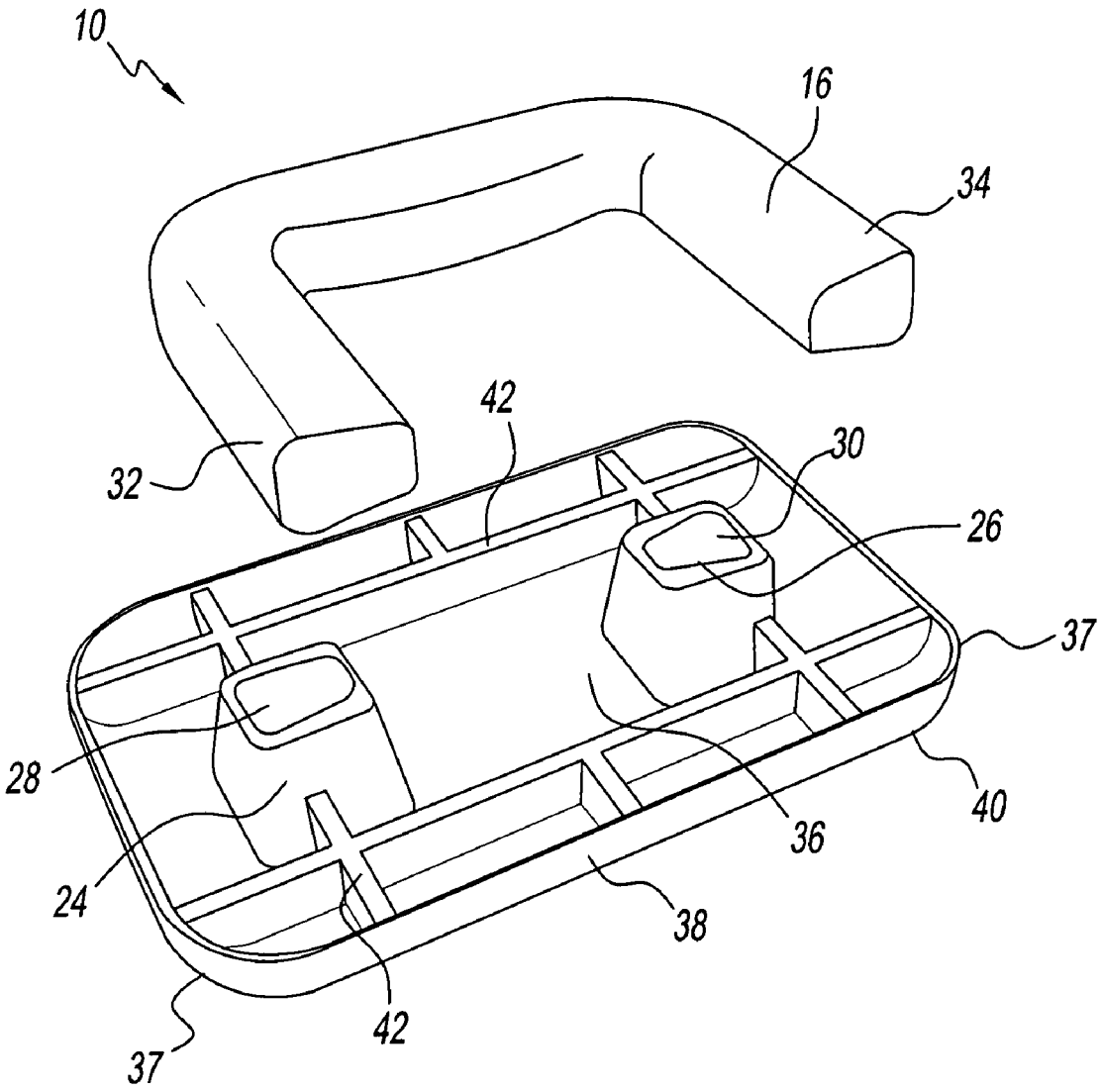
FIG. 2 is a top perspective view of the hand-held trash compactor illustrating the feature of a removable handle.

Handle 16 is preferably removably connected to base 12 of trash compactor 10. FIG. 2 shows trash compactor 10 with handle 16 removed. In one preferred embodiment, trash compactor 10 has connecting members 24, 26 that extend upward from base 12. Connecting members 24, 26 include apertures 28, 30 for receiving arms 32, 34 of handle 16 in an interference or press fit. In the embodiment shown in FIG. 2, arms 32, 34 have a trapezoidal cross-section corresponding to the shape of apertures 28, 30 of connecting members 24, 26. It should be understood, however, that any other suitable cross-section may be used. Alternatively, handle 16 may be connected to base 12 by a snap fit. Preferably, handle 16 is adjustable. In one embodiment, arms 17 can be telescoping to lengthen or contract depending on a user's height or the height of the trash receptacle. Advantageously, handle 16 can be removed to allow trash compactor 10 to be stored in a small space such as a kitchen drawer or cabinet.

Base 12 of trash compactor 10 comprises a substantially flat portion 36 connected to a lip portion 38 that extends upward from the flat portion. Flat portion 36 preferably has rounded corners 37 to facilitate movement and alignment without piercing or poking the trash receptacle. Lip portion 38 prevents a user's hand from contacting the trash while using trash compactor 10. Preferably, lip portion 38 is integrally formed with flat portion 36, forming a smooth radius 40 between lip portion 38 and flat portion 36. Smooth radius 40 allows trash compactor 10 to be used with a flexible plastic receptacle such as a garbage bag without causing tears or snags. Base 12 also includes a plurality of support ribs 42 extending upward from flat portion 36 in a direction substantially perpendicular to flat portion 36. The support ribs 42 are also connected to the lip portion 38. Support ribs 42 provide strength and stability to base 12 while minimizing the weight of the base and thus the overall weight of hand-held trash compactor 10. Support ribs 42 also divide top surface 14 of base 12 into compartments to hold items, such as ties or fasteners to tie a trash bag after use of trash compactor 10. Base 12 may be constructed from a polymer material. For example, base 12 may be constructing with plastic using polypropylene, polystyrene, polyvinyl, thermoplastic, and/or plastic laminate. In one embodiment, base 12 has a unitary injection-molded plastic body.

Figure 3:
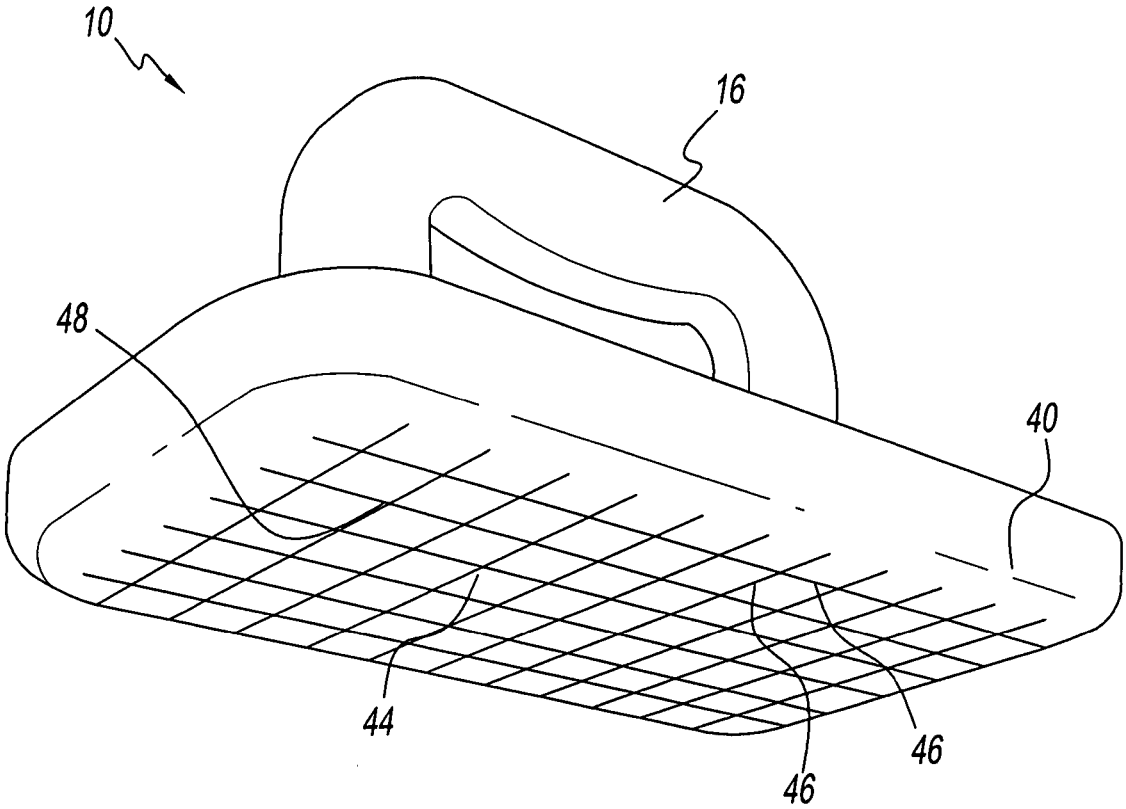
FIG. 3 is a bottom perspective view of the hand-held trash compactor of FIG. 1.

FIG. 3 shows a bottom surface 44 of base 12. Bottom surface 44 preferably has a plurality of grooves 46 formed in the bottom surface. Grooves 46 may be positioned substantially parallel to one another. Preferably, grooves 46 are arranged in a grid pattern 48. Grooves 46 provide increased friction between bottom surface 44 and the trash being compacting, thus increasing the efficiency of trash compactor 10. Alternatively, ridges or projections could be used for this same purpose. Bottom surface 44 may be a non-stick surface. The non-stick surface may be formed using non-stick plastics, silicon polymers, and/or teflon coated plastics. Bottom surface 44 may also be an anti-microbial surface. The anti-microbial surface may be formed using anti-microbial agents that prevent the formation of microbial colonies. For example, it is contemplated herein that anti-microbial powder coatings or anti-fungal agents using sasa tannins or sasa extract may be used.

Figure 4:
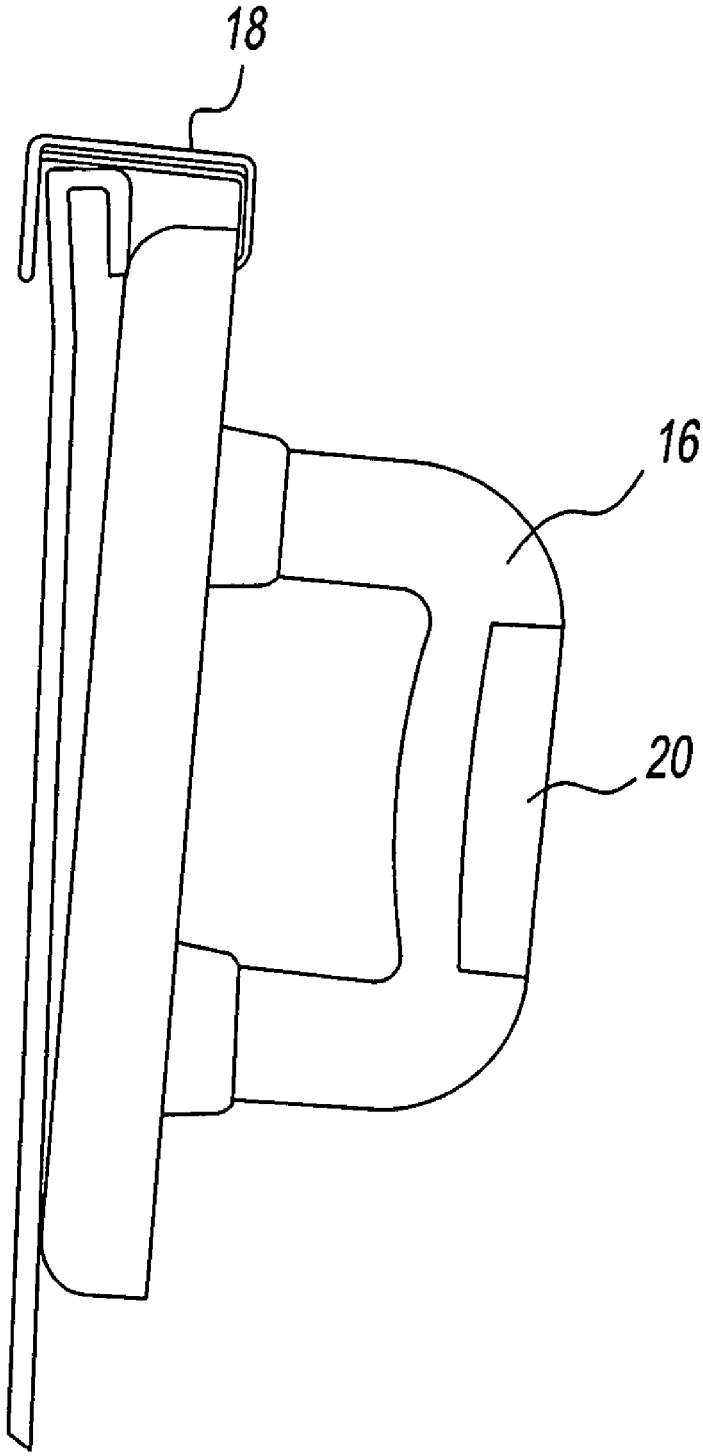
FIG. 4 is a side view of the hand-held trash compactor of FIG. 1.

Hook 18 is preferably pivotally connected to base 12. In the embodiment shown in FIG. 1, hook 18 is connected to base 12 by two flanges 50 extending outward from lip 38. Each flange 50 includes a hole 52 extending through the flange. Hook 18 has a cylindrical rod 54. Each end of cylindrical rod 54 engages holes 52 on each of the flanges 50. Cylindrical rod 54 forms a loop that is bent approximately 90 degrees in one or more locations. Cylindrical rod 54 engages holes 52 with a loose interference fit, allowing for rotation of cylindrical rod 54 within holes 52, which, in turn, allows hook 18 to rotate from an operational position, as shown in FIG. 1, to a storage position, as shown in FIG. 4. Advantageously, when in the storage position, hook 18 allows a user to hang trash compactor 10 in a convenient location, for example on the wall of a closet or on a side of a trash receptacle.

In the embodiment shown in FIGS. 1 through 4, base 12 of trash compactor 10 is substantially rectangular in shape with rounded corners. However, it is contemplated that base 12 may any number of shapes, including substantially circular or substantially oval. Preferably, trash compactor 10 does not have any sharp corners, to avoid tearing or puncturing the trash receptacle. Trash compactor 10 may be used with a wide variety of trash receptacles, including receptacles for holding household trash and yard waste. Additionally, trash compactor 10 may be formed in a range of sizes to accommodate trash receptacles of various sizes. Trash compactor 10 is lightweight, portable, easy to store, and usable with a wide variety of trash receptacles.

While the trash compactor has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the disclosure without departing from the scope thereof. Therefore, it is intended that the invention not be limited to the particular embodiment(s) disclosed as the best mode contemplated, but that the invention will include all embodiments falling within the scope of the appended claims.

The invention claimed is:

1. A hand-held trash compactor comprising:

a base comprising a top surface and a bottom surface, the top surface comprising a substantially flat portion;

a handle removably connected to the top surface of the base, the handle extending upward from the top surface;

a lip portion connected to the substantially flat portion and extending upward from the substantially flat portion, the lip portion having a height and extending circumferentially about the substantially flat portion;

at least two supporting ribs extending from, and in a direction substantially perpendicular to, the substantially flat portion, the at least two supporting ribs being connected to the lip portion, the at least two supporting ribs intersecting each other to form a plurality of compartments for holding items; and a hook comprising a first end and a second end, the second end being pivotably connected to the top surface of the base, wherein the hook is movable between an operational position and a storage position, wherein the first end of the hook is located on a side of the bottom surface that is opposite from the top surface when the hook is in the operational position, and the first end of the hook is located on a side of the top surface when the hook is in the storage position, and wherein the bottom surface has a plurality of grooves arranged in a grid pattern.

2. The hand-held trash compactor of claim 1, wherein the handle is adjustable in height.

3. The hand-held trash compactor of claim 1, wherein the handle is removably connected to the base using an interference fit.

4. The hand-held trash compactor of claim 1, wherein the handle is substantially U-shaped.

5. The hand-held trash compactor of claim 4, wherein the handle further comprises cushioning.

6. The hand-held trash compactor of claim 1, wherein the bottom surface has a non-stick surface.

7. The hand-held trash compactor of claim 1, wherein the base is made of a polymer material.

8. The hand-held trash compactor of claim 1, wherein the base is a unitary injection-molded plastic body.

9. The hand-held trash compactor of claim 1, wherein the base is substantially rectangular with rounded corners.

* * * * *